US005740646A

United States Patent [19]

Wirkus et al.

[11] Patent Number: 5,740,646

[45] Date of Patent: Apr. 21, 1998

[54] GLASS BRICK WALL

[76] Inventors: Randolf Andrew Wirkus; Michelle Ann Wirkus, both of 32 Norm Street, Kenmore, Queensland, 4069, Australia

[21] Appl. No.: 591,561

[22] PCT Filed: Aug. 15, 1994

[86] PCT No.: PCT/AU94/00472

§ 371 Date: Feb. 13, 1996

§ 102(e) Date: Feb. 13, 1996

[87] PCT Pub. No.: WO95/05510

PCT Pub. Date: Feb. 23, 1995

[30] Foreign Application Priority Data

| | | | |
|---|---|---|---|
| Aug. 13, 1993 | [AU] | Australia | PM 0556 |
| Oct. 28, 1993 | [AU] | Australia | PM 2105 |
| Nov. 17, 1993 | [AU] | Australia | PM 2484 |
| Dec. 6, 1993 | [AU] | Australia | PM 2827 |
| Jun. 21, 1994 | [AU] | Australia | PM 6385 |

[51] Int. Cl.[6] ..... E04B 5/46; E04C 1/42

[52] U.S. Cl. ..... 52/308; 52/306; 52/307; 52/474; 52/481.1; 52/481.2; 52/781.3

[58] Field of Search ..... 52/306–308, 471.1, 52/475.1, 476, 479, 481.1, 481.2, 482, 762, 764, 781.3

[56] References Cited

U.S. PATENT DOCUMENTS

| | | | |
|---|---|---|---|
| 2,281,524 | 4/1942 | Meyers | 72/42 |
| 4,636,413 | 1/1987 | Wittman et al. | 52/306 X |
| 4,918,882 | 4/1990 | Funk | 52/335 X |
| 4,965,975 | 10/1990 | Schwartz | 52/308 |
| 4,986,048 | 1/1991 | McMarlin | 52/306 |
| 5,010,704 | 4/1991 | Thompson | 52/308 |
| 5,031,372 | 7/1991 | McCluer | 52/307 |
| 5,067,295 | 11/1991 | Francik et al. | 52/306 |
| 5,430,985 | 7/1995 | Coleman | 52/308 |

OTHER PUBLICATIONS

*PC Gloss Blocks* Advertisement, PC Corning, Oct. 28, 1948, pp. 14, 15, 21.

*Primary Examiner*—Carl D. Friedman
*Assistant Examiner*—W. Glenn Edwards
*Attorney, Agent, or Firm*—Fitzpatrick, Cella, Harper & Scinto

[57] ABSTRACT

A glass brick wall is provided including a plurality of generally rectangular glass bricks layed in horizontal runs between spaced elongated vertically extending support frame members. The wall has horizontally extending elongated separation stripe between adjacent horizontal runs. The vertical support frame members present a face incorporating vertically spaced apertures receiving the separation strips.

28 Claims, 6 Drawing Sheets

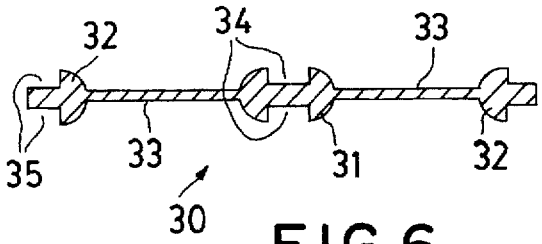
FIG. 6
FIG. 7(A)
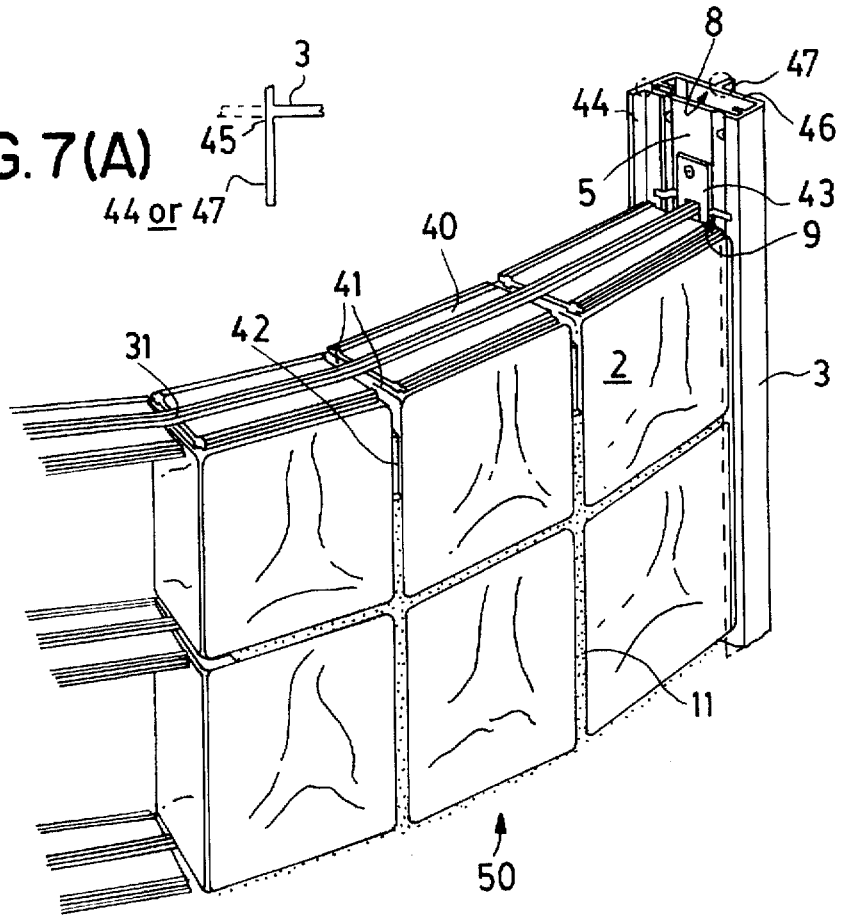
FIG. 7(B)
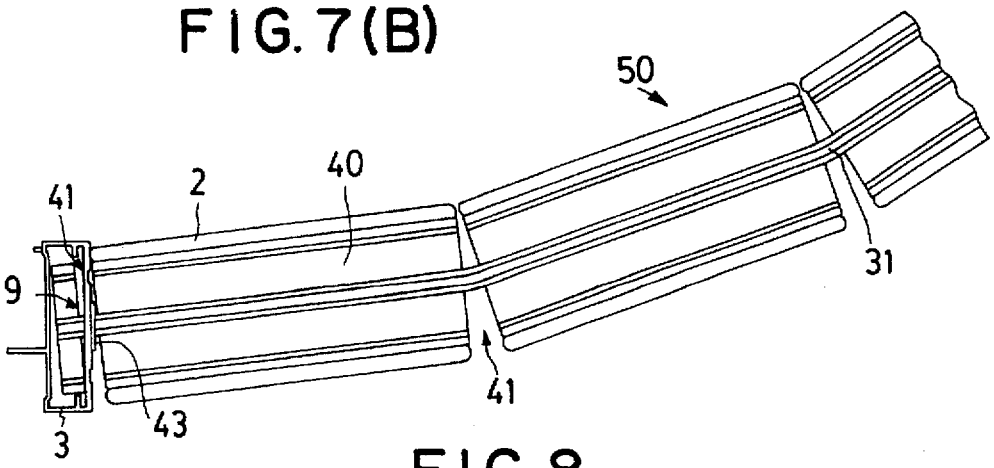
FIG. 8

GLASS BRICK WALL

TECHNICAL FIELD OF THE INVENTION

THIS INVENTION relates to a glass brick wall or partition and in particular, but not limited to an improved method of construction of a glass brick wall or partition using an improved support frame.

In most systems glass bricks are usually box like in shape being made from two hollow halves welded together. This results in a central weld bead between marginal ridges forming a peripheral channel around the glass brick. Channels of adjacent bricks are placed side-by-side and grouting or other filler is used to fill the channel between adjacent glass bricks and a wall is made up in this fashion.

Many different methods are used in the building industry to build glass brick walls using various borders comprising channel shaped support frames with peripheral glass bricks being located in the channel. This method of construction allows for a border giving a clean back or outer surface of the channel shaped support frame to be retained against adjacent walls or structure. In these methods, separation strips are used between the glass bricks and adhesive is applied between the strips and the bricks.

These known walls suffer from a number of disadvantages. Separation strips used to separate each glass brick are not well supported, and due to the glass bricks being located in the channel, moisture can find its way into the channel shaped support frame. All these disadvantages have a detrimental effect on the adhesive used to secure the glass bricks to the support frame. Further, the separation strips are not effectively retained or supported by the support frame.

Consequently, by using these methods of construction of a glass brick wall or partition, there can be potentially a high risk that the wall may fall or be pushed out without very much force.

OUTLINE OF THE INVENTION

It is an object of the present invention to alleviate at least to some degree the aforementioned problems associated with the prior art.

In accordance with one aspect therefore, the present invention resides in a glass brick wall comprising a plurality of generally rectangular glass bricks layed in horizontal runs between spaced elongated vertically extending support frame members, the wall having horizontally extending elongated separation strips between adjacent horizontal runs, characterised in that, the vertical support frame members present a face incorporating vertically spaced apertures receiving said separation strips.

In accordance with another alternative aspect, there is provided a curved glass brick wall including a separation strip between adjacent horizontal runs of glass bricks, the strip having cut-out portions at spaced intervals between straight strip sections so that the cut-out portions provide a bending site so adjacent strip sections in the wall are angled relative to one another to provide an overall curve.

In accordance with a further alternative aspect, there is provided a glass brick wall comprising a plurality of generally rectangular glass bricks layed in horizontal runs between spaced elongated vertically extending support frame members, the wall having horizontally extending elongated separation strips between adjacent horizontal runs, characterised in that, the separation strips have opposed longitudinally extending beading locating the separation strips between the runs of bricks and each separator strip being supported at its end by a bracket having a support member projecting into a space between the channel of an adjacent glass brick and the separation strip.

In a still further alternative aspect, there is provided a glass brick wall having a support assembly utilising channels so formed in the glass bricks to support a separation strip between adjacent glass bricks, the separation strip having opposed longitudinally extending beading locating the separation strip in said channels of said adjacent glass bricks and the separation strip being supported at its end by a bracket having a support member projecting into a space between the channel of an adjacent glass brick and the separation strip.

The bracket support members are typically a plurality of fingers adapted to straddle the separation strip thereby projecting into the channels of adjacent glass bricks with fingers projecting into the channels above and below the separation strip. The fingers are typically about the same thickness as the beading so that the fingers locate flush or below the beading in the separation strips. Typically two fingers are positioned on either side of the separation strip, the fingers protruding generally at 90° to the bracket body, the bracket body being generally planar and being adapted to be fastened to a wall, frame or the like. Preferably, the bracket includes a marker or position indicating means so the bracket can be located at a predetermined position so that the separation strip supported by the bracket is positioned generally at 90° to the wall or support to which the bracket is fitted.

The support frame members can be of any desirable shape but are typically box-like or channel-like in section. Preferably, the support frame members have a channel-like cross-section including a bridging web section extending between opposed flanges. Each flange can include one or more return flanges. Typically, the web section includes an outer face and a vertical run of bricks abut against the outer face, the outer face of the web section presenting a face incorporating vertically spaced apertures receiving the separation strips.

Typically, the return flanges are of a sufficient size to enable the separation strips to be securely supported by the flanges, the return flanges and the apertures. Typically, the return flange is slotted to receive the separation strip.

Preferably, where the return flanges and the flanges intersect, a frangible join is formed in the extrusion process. Typically, the frangible joins are in the form of a V-shaped notch so that a marginal portion of a flange can be snapped off from the support frame at the V-shaped notch, if the marginal portion of the flange is not required for the construction of the glass brick wall.

The apertures can be of any desired shape but are preferably generally matched to the section of the separation strips to provide a tight fit. Typically, the apertures comprise spaced horizontal slots.

Preferably, the separation strips are also adhered firmly to the support frame on an opposite surface to the slots in the C-shaped channel.

Each glass brick is typically made from edge welded together dish-like sections having a weld bead extending around the brick in a shallow recessed side wall thereof, each of the separation strips being self locating in adjacent recesses between glass bricks of adjacent horizontal runs. Typically, each separation strip has transversely spaced pairs of back-to-back channels for holding jointing paste and opposed relatively thick marginal edge portions being transversely spaced and separated by recess register means adapted to project into the glass brick recess to automatically locate the separation strips, each pair of back-to-back channels sharing a relatively thin wall and the separation strip having a relatively thick central medial portion located over the weld bead.

Preferably, the separation strips can be produced from plastics or metal materials known in the building or construction industries. Further, these plastics or metal separation strips can be produced to give a constant space between each glass brick in the glass brick wall in both the horizontal and vertical planes so that the glass brick wall can be accurately built.

In another preferred embodiment, the separation strips can be made from extruded aluminium having any suitable cross sectional profile for the construction of the glass brick wall-of the present invention.

In a preferred embodiment, a typical separation strip involves an elongate strip of thin sheet material marginally narrower than a side wall of a glass brick, the glass brick being of the type made from welded together halves where the side wall has a relatively wide and shallow recess extending around the glass brick and a weld bead generally centrally disposed in the recess, the strip having opposed marginal edge portions adapted to fit between adjacent glass bricks just beyond the shallow recess and having tapered recess register means merging from the marginal edge portions and extending into the shallow recesses of adjacent glass bricks, so that the separation strip is automatically centred in the recesses of adjacent glass bricks.

The separation strip typically employs spaced pairs of back-to-back channels for holding jointing paste, the channels being inboard of the recess register means and being bounded by the recess register means and inner elongate beading members, the marginal edge portions being relatively thick and the back to back channels being separated by a relatively thin shared wall so as to minimise the amount of material used in the separation strip without compromising strength.

Preferably, in order to maintain the strength of the strip, the strip includes a medially bulged portion having back-to-back relatively narrow channels positioned and adapted to accommodate the respective weld beads of the adjacent glass bricks.

In another embodiment, the separation strip is segmented and manipulated to provide a non-planar glass brick wall. Preferably, the segmented separation strip has transverse divisions extending outwardly from each side of the medial portion of the separation strip.

Typically, the transverse divisions in the separation strips are in the form of wedge shaped cut-out segments so that the medial portion between the cut out segments can be manipulated to follow a predetermined shape, for example, to form a curved glass brick wall.

Preferably, the cut out segments are stamped or cut out of the separation strips so that successive cut out segments are at intervals coinciding with the lengths of the glass bricks being used in the construction of the glass brick wall. Typically, the lengths of glass bricks used in the construction of glass brick walls include 240 mm, 115 mm, 190 mm, 146 mm or 300 mm.

Preferably, the cut out segments in the separation strips can be cut or stamped out of any suitable width so that as each glass brick is positioned on the segmented separation strips, enough space is allowed between each glass brick for the construction of the curved glass brick wall. Typically, the cut out segments have a width of about 10 mm.

In another preferred embodiment where a curved glass brick wall is being constructed, the segmented separation strips used are secured to the support frame using any suitable securing means. Typically, the securing means is in the form of a horse shoe shaped brace so that the brace can be located in the cut out segments of the separation strips that are inserted into the slots in the support frame. Preferably, the horse shoe shaped braces are secured onto the support frame so that the segmented separation strips remain in a fixed position in relation to the support frame.

In a most preferred form, the extruded aluminium support frame may be manufactured with longitudinally extending V-shaped grooves running along the length of the face incorporating the apertures so that adhesive can be applied in the desired position to achieve optimum performance of the adhesive when constructing the glass brick wall.

BRIEF DESCRIPTION OF THE DRAWINGS

In order that the invention can be more readily understood and be put into practical effect, reference will now be made to the accompanying drawings and wherein:

FIG. 6 is a sectional view of another preferred embodiment of a separation strip used in the construction of a glass brick wall as illustrated in FIGS. 1, 2, 7 and 8;

FIGS. 7(*a*) and 7(*b*) are pictorial views of a partly completed construction of a curved glass brick wall of the present invention;

FIG. 8 is a plan view illustrating the securing of a segmented separation strip to the support frame used in the construction of the curved glass brick wall of the present invention;

METHOD OF PERFORMANCE

Figure 1:
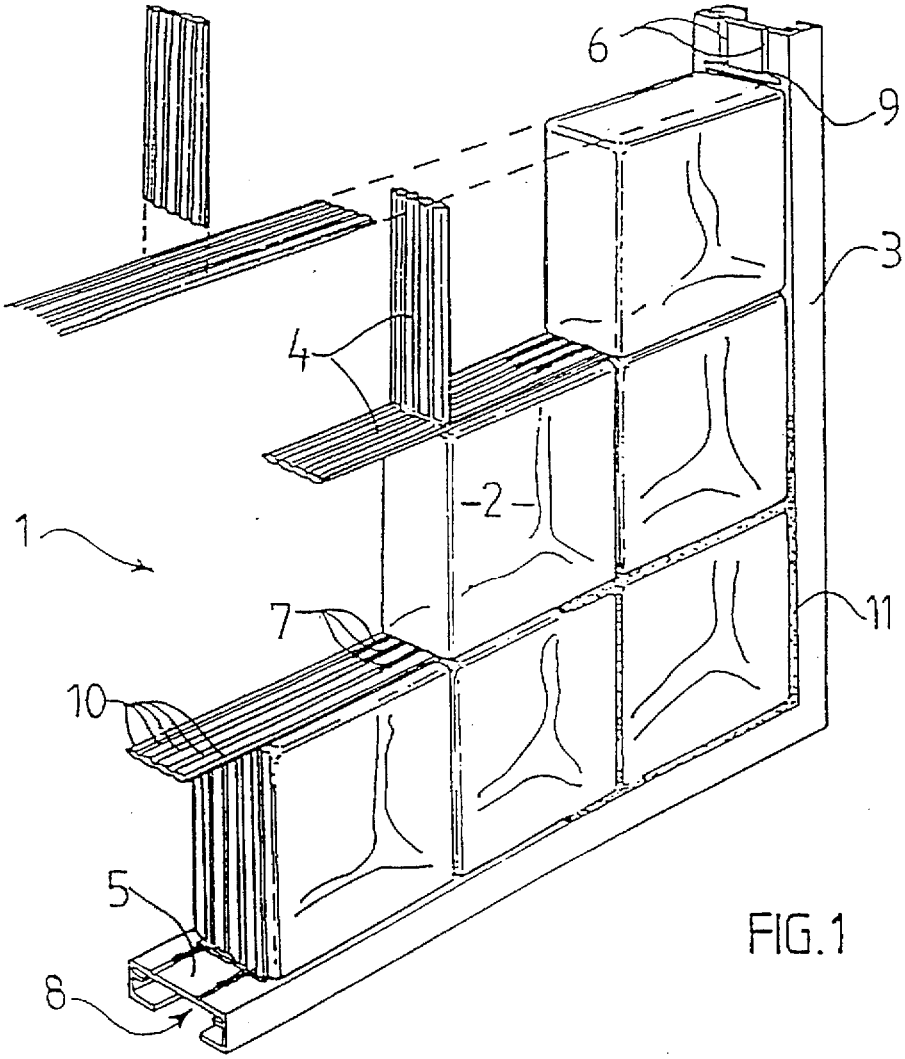
FIG. 1 is a pictorial view of a partly completed construction of a glass brick wall of the present invention.

Referring to FIG. 1, there is illustrated a partly completed construction of a glass brick wall 1 of the present invention. The glass brick wall 1 is constructed using glass bricks 2 and a support frame 3. The support frame 3 is in the form of a C-shaped channel 8 with a supporting surface in the form of a full surface 5 having glass bricks 2 abutted directly against the full surface 5.

The full surface 5 has two V-shaped grooves 6 to allow an adhesive to be easily and correctly positioned on the full surface 5 before the glass bricks 2 are placed in position. Typically, the adhesive is in the form of a silicone constructor seal 7.

Preferably, the support frame 3 in the form of C-shaped channel 8 is manufactured from aluminium and can be extruded using techniques known in the aluminium extrusion industry.

When the glass bricks 2 are being placed in the glass brick wall 1, they can be correctly positioned by using separation strips 4.

In the embodiment of FIG. 1, the separation strips 4 are manufactured using PVC plastics. In their manufacture, the PVC separation strips 4 have a number of grooves 10 formed in both surfaces of the strips 4. Typically five grooves 10 are formed on each surface of the separation strips 4 so that either silicone constructor seal 7 and/or grouting 11 can be easily applied into the correct positions via the grooves 10 when constructing the glass brick wall 1.

Before construction of the glass brick wall 1, the separation strips 4 are pre-cut to the dimensions of a particular job for the glass brick wall 1. The separation strips 4 are placed between each glass brick 2 in the glass brick wall 1 in both horizontal and vertical directions. Preferably, the separation strips 4 used in the horizontal direction are one piece and extend between vertically spaced support frames 3 of the glass brick wall 1. These one piece separation strips 4 are cut to a length so that they can be inserted into apertures which in this case are vertically spaced slots 9 in the full surface 5 of the support frame 3 to provide greater support to the glass brick wall 1.

The separation strips 4 in the vertical direction are cut to fit in between the glass bricks 2 and the lengths of the horizontal separation strips 4 so that each glass brick 2 is framed and correctly positioned in the glass brick wall 1.

In FIG. 1, the full surface 5 of the support frame 3 has apertures in the form of slots 9. The slots 9 are cut into the full surface 5 at predetermined positions to coincide with the dimensions of the glass bricks 2 and the separation strips 4. The slots 9 are made of a width wide enough to allow the insertion of the separation strips 4 through into the C-shaped channel 8 of the support frame 3.

By applying the silicone constructor seal 7 in an appropriate way to the full surface 5 of the support frame 3, the separation strips 4, and the glass bricks 2, the glass brick wall 1 can be successfully constructed to fit any reasonable application in the building and construction industries.

Figure 2:
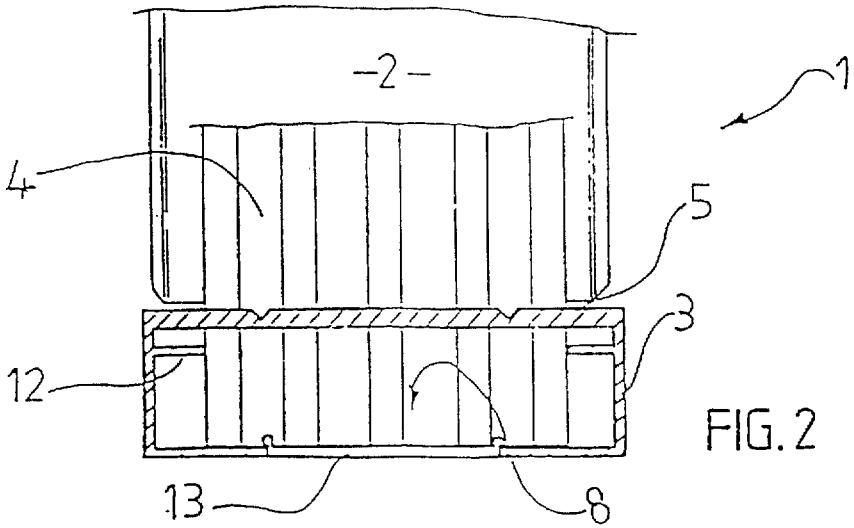
FIG. 2 is a plan view of an arrangement of a support frame used in the construction of the glass brick wall illustrated in FIG. 1.

Referring to FIG. 2, a plan view shows a cut-away section of a glass brick 2 abutting directly against a support frame 3 and a separation strip 4.

As described in FIG. 1, the support frame 3 is in the form of a C-shaped channel 8 with a supporting surface in the form of a full surface 5. Preferably, the support frame 3 is manufactured from aluminium and is formed using extrusion techniques known to a skilled person in the aluminium construction industries.

The full surface 5 of the support frame 3 is formed with apertures in the from of slots 9 at predetermined positions in the full surface 5 to allow the glass bricks 2 to be correctly placed and easily positioned in the glass brick wall 1. The full surface 5 of the support frame 3 has two V-shaped grooves 6 formed in the full surface 5 so that the silicone constructor seal 7 can be easily applied and correctly positioned on the full surface 5 of the support frame 3.

The support frame 3 has means in the form of return flanges 12 positioned on an inside surface of the C-shaped channel 8 of the support frame 3 so that further support can be provided to the inserted separation strip 4. These return flanges are typically slotted to take the separation strip.

In construction, if one or more sides of the support frame 3 is/are free-standing, an unsightly gap in the open surface of the C-shaped channel 8 which normally is concealed by a surrounding structure or wall of the building is revealed. This gap can be covered using a clip-on section 13 which can be made from either aluminium or plastics material.

Figure 3:
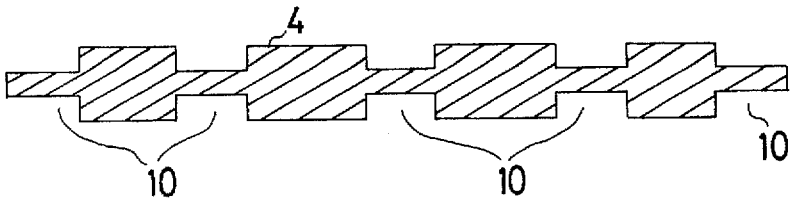
FIG. 3 is a sectional view of a separation strip used in the construction of a glass brick wall as illustrated in FIGS. 1 and 2.

Referring to FIG. 3, there is illustrated a sectional view of a preferred form of the separation strip 4. In this embodiment, there are five grooves 10 on each surface of the separation strip 4 so that the silicone constructor seal 7 and/or grouting 11 can be applied easily and correctly positioned to the strip 4 so that the glass brick wall (not shown) is appropriately adhered together to provide optimum strength.

Figure 4:
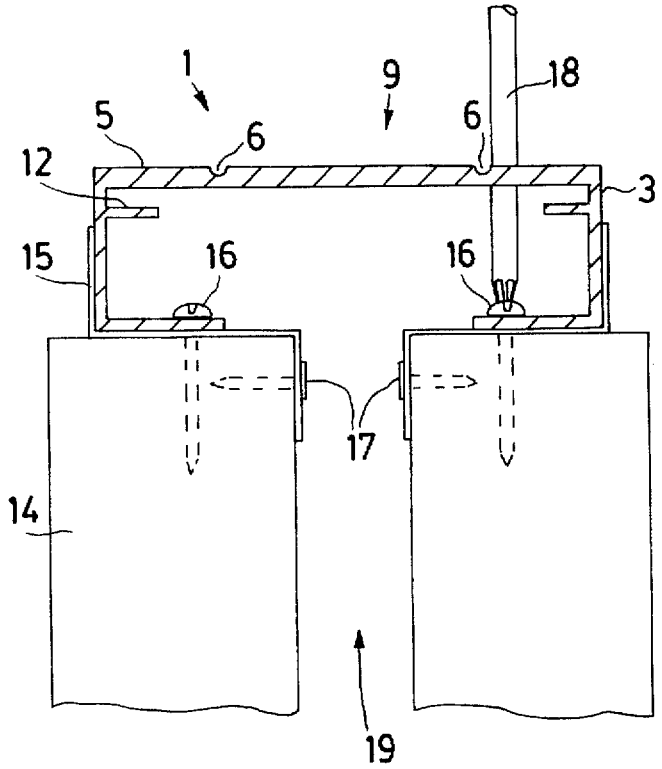
FIG. 4 is a plan view illustrating a method of securing the support frame used in the construction of a glass brick wall of the present invention to a surrounding structure of a building or construction.

In FIG. 4, there is illustrated a method of securing the support frame 3 onto a surrounding structure 14 of a wall or building. Before securing the support frame 3 onto the surrounding structure 14, a flashing 15 can be placed into position and secured by nails 17 or the like to help stop any moisture from seeping into the glass brick wall 1.

The support frame 3 can be secured to the surrounding structure 14 by using any suitable securing means known to a skilled person in the art. Typically, the securing means is in the form of a screw 16 which is screwed through both the support frame 3 and flashing 15 into the surrounding structure 14. In this diagram, a screwdriver 18 is passed through the slot 9 to enable the screw 16 to be screwed into the surrounding structure 14.

It can be seen from this arrangement any moisture which may get into the support frame 3 of the glass brick wall 1 would be conducted away from the glass brick wall 1 into a cavity 19 in the surrounding structure 14. This arrangement in FIG. 4 should increase the potential life of the glass brick wall of the present invention considerably by keeping the moisture content in the wall 1 to a minimum.

Figure 5:
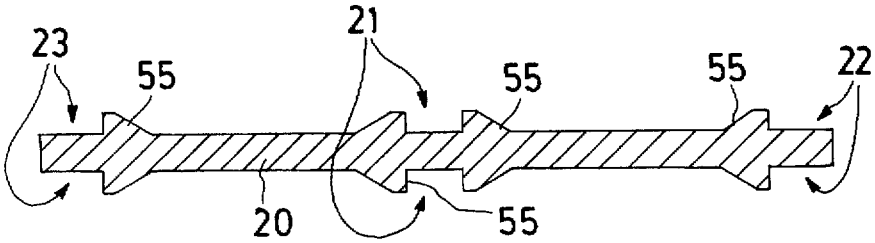
FIG. 5 is a sectional view of a further preferred embodiment of a separation strip used in the construction of a glass brick wall as illustrated in FIGS. 1 and 2.

Referring to FIG. 5, there is illustrated a sectional view of another preferred embodiment of a separation strip 20 for the construction of the glass brick wall shown in FIGS. 1 and 2. In this embodiment, the separation strip 20 is extruded from aluminium so that increased rigidity and safety features can be incorporated into the construction of the glass brick wall of the present invention.

In FIG. 5, the extruded aluminium separation strip 20 has a central groove 21 extruded into both top and bottom surfaces of the strip 20 so that adhesives can be accurately placed onto the strip 20. The separation strip 20 has marginal edge grooves 22, 23 along each side edge of the strip 20 so that adhesives and/or grouting can be placed in between the glass bricks in the wall (not shown). Arrow shaped recess register means 55 help to locate the separation strip between adjacent glass bricks.

Referring to FIG. 6, there is illustrated a sectional view of another preferred embodiment of a separation strip in the form of an extruded aluminium separation strip 30. In this embodiment, the extruded aluminium strip 30 is manufactured in the extrusion process with a central, side and connecting portions 31, 32 and 33 respectively.

In FIG. 6, the central portion 31 has been extruded with back-to-back narrow channels 34 so that the adhesives and/or grouting can be inserted effectively and with great accuracy in the construction process of the glass brick wall.

Similarly, the side portions 32 are extruded with recessed marginal edge portions 35 on both side edges of the separation strip 30 to allow the efficient and accurate insertion of adhesives and/or grouting in the construction process of the glass brick wall.

Additional channels are provided by a shared wall 33 between the central and side portions 31 and 32, the wall 33 being extruded having a narrower gauge of aluminium so that the quantity of aluminium used in the extrusion process is kept to a minimum. The shared wall of channels 34 is thicker to maintain strength.

Referring to FIGS. 7(A) and 7(B), there are illustrated pictorial views of a partially completed construction of a curved glass brick wall of the present invention using the same glass bricks 2 as shown in FIGS. 1 and 2.

In FIGS. 7(A) and 7(B), the separation strips 30 are in the form of segmented separation strips 40 so that the segmented separation strips 40 can be bent to follow a predetermined shape of the curve in the glass brick wall under construction. The segmented separation strips are formed by cutting or stamping out transverse outwardly extending or wedge shaped divisions from each side of the central portion 31 of the separation strips 30.

The transverse extending divisions are in the form of cut-out segments 41. The central portions 31 remaining between the cut-out segments 41 in the segmented separation strips 40 are then bent to follow the predetermined shape of the curve in the glass brick wall 50. The cut-out segments 41 are cut or stamped out in the segmented separation strips 40 so that the successive cut-out segments 41 are at intervals coinciding with the length of the glass bricks 2 used in the construction of the curved glass brick wall 50.

The spaces between the glass bricks 2 and the segmented separation strips 40 are filled with any suitable expanding setting filler and can take the form of a polyurethane filler 42 and/or grouting 11 which is well known to a person skilled in the glass brick or building industries.

There is further illustrated a preferred embodiment where the support frame 3 has along each side edge of its full surface 5 side extensions. These side extensions are in the form of side support flanges 44 and are of sufficient size so that, if required, the segmented separation strips 40 are securely supported by both the side support flanges 44 and the support frame 3.

The circled expanded view of FIGS. 7(A) and 7(B) illustrate the side support flanges 44 being a part of the C-shaped support frame extruded from a single piece of aluminium where the side support flanges 44 and the support frame 3 intersect, a frangible join in the form of a V-shaped notch 45 is formed so that the side support flanges 44 can be snapped off from the support frame 3 at the V-shaped notch 45 if the flanges 44 are not required for the construction of the curved glass brick wall 50.

FIGS. 7(A) and 7(B) further illustrate a clip-on section also extruded from a single piece of aluminium and is in the form era clip-on section 46 having an outwardly extending support panel 47. The support panel 47 is used to fix the support frame to the surrounding building panels (not shown) so that the glass brick wall 50 is securely held in position.

Where the support panel 47 and the clip-on section 46 intersect, a frangible join in the form of a V-shaped notch 45 is formed as in the case for the frangible join between the side support flanges 44 and the support frame 3.

This is illustrated in the circled expanded view of FIGS. 7(A) and 7(B) showing the frangible join being the V-shaped notch 45. The support panel 47 can be snapped off from the clip-on section 46 at the V-shaped notch 45, if not required, so that the clip-on panel 46 without the support panel 47 is used only to cover the gap in the open surface 8 of the support frame 3.

The segmented separation strips 40 are secured to the support frame 3 by a securing means in the form of horse shoe shaped braces 43. The horse shoe shaped braces 43 are located in the cut-out segments 41 inserted into the slots 9 in the support frame 3 so that the segmented separation strips 40 can remain in a fixed position in relation to the support frame 3.

Referring to FIG. 8, there is a plan view illustrating the segmented separation strip 40 inserted into and secured to the support frame 3 for the construction of the curved glass brick wall 50.

In FIG. 8, the segmented separation strip 40 is secured to the support frame 3 using the horse shoe shaped brace 43 located in the cut-out segment 41 inserted into slot 9 of the support frame 3.

The segmented separation strip 40 is bent at the central portions 31 between the successive cut-out segments 41 so that the strips 40 follow the predetermined shape of the curve in the glass brick wall 50.

FIG. 8 also illustrates the successive cut-out segments 41 coinciding with the lengths of each glass brick 2 so that the glass bricks 2 when positioned on the segmented separation strips 40 follow the predetermined shape of the curve bent into the segmented separation strips 40 to form the glass brick wall 50 of the present invention.

Figure 9:
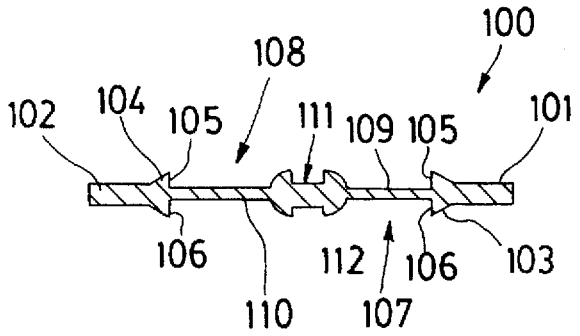
FIG. 9 is a cross-section through a further embodiment of a separation strip suitable for use in the present invention.

Referring to FIG. 9, there is illustrated a separation strip 100 having opposed marginal edge portions 101 and 102 of relatively thick material, the opposed marginal edge portions 101 and 102 merging into tapered sections 103 and 104 terminating in shoulders 105 and 106. The strip includes back-to-back channels 107 and 108 where the adjoining walls 109 and 110 are deliberately made thin to minimise the amount of material employed to make the strip.

In order to strengthen the strip, it includes a relatively thick section 111 centrally disposed, the relatively thick section 111 having back-to-back relatively narrow channels 111 and 112.

Figure 10:
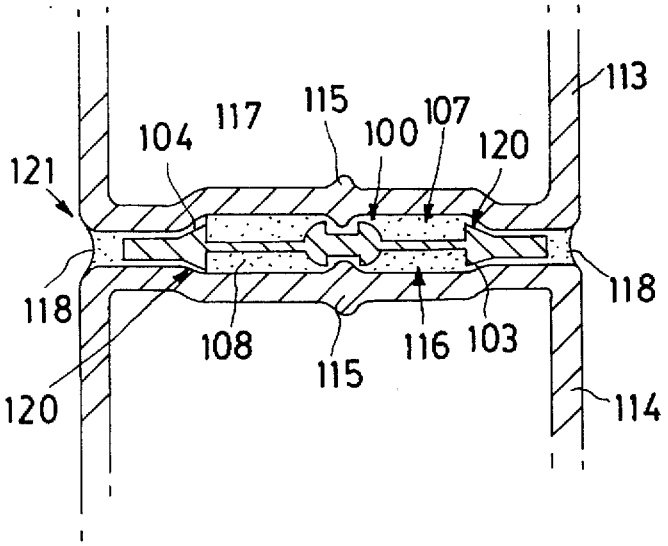
FIG. 10 is a section through a portion of a glass brick wall showing use of the separation strip of FIG. 9.

FIG. 10 illustrates how the strip of FIG. 1 is used, and as can be seen, two glass bricks 113 and 114 are placed together with the separation strip 100 between them. The glass bricks include welds 115 and recesses 116 and 117. The channels 111 and 112 accommodate the welds 115 while a jointing paste in the form of silicone gel for example, is placed in the back-to-back channels 107 and 108. Grouting 118 is employed to complete the assembly.

As can be seen in FIG. 10, the tapered sections 103 and 104 of the strip serves as a recess register means in that the strip is automatically centred in the recesses 116 and 117.

Another feature of the tapers 103 and 104 is that some glass bricks have a steeper shoulder or transition region from the edge 121 of the glass brick to the respective recesses 116 and 117. The strip 100 clearly can also be used with this kind of glass brick.

Figure 11:
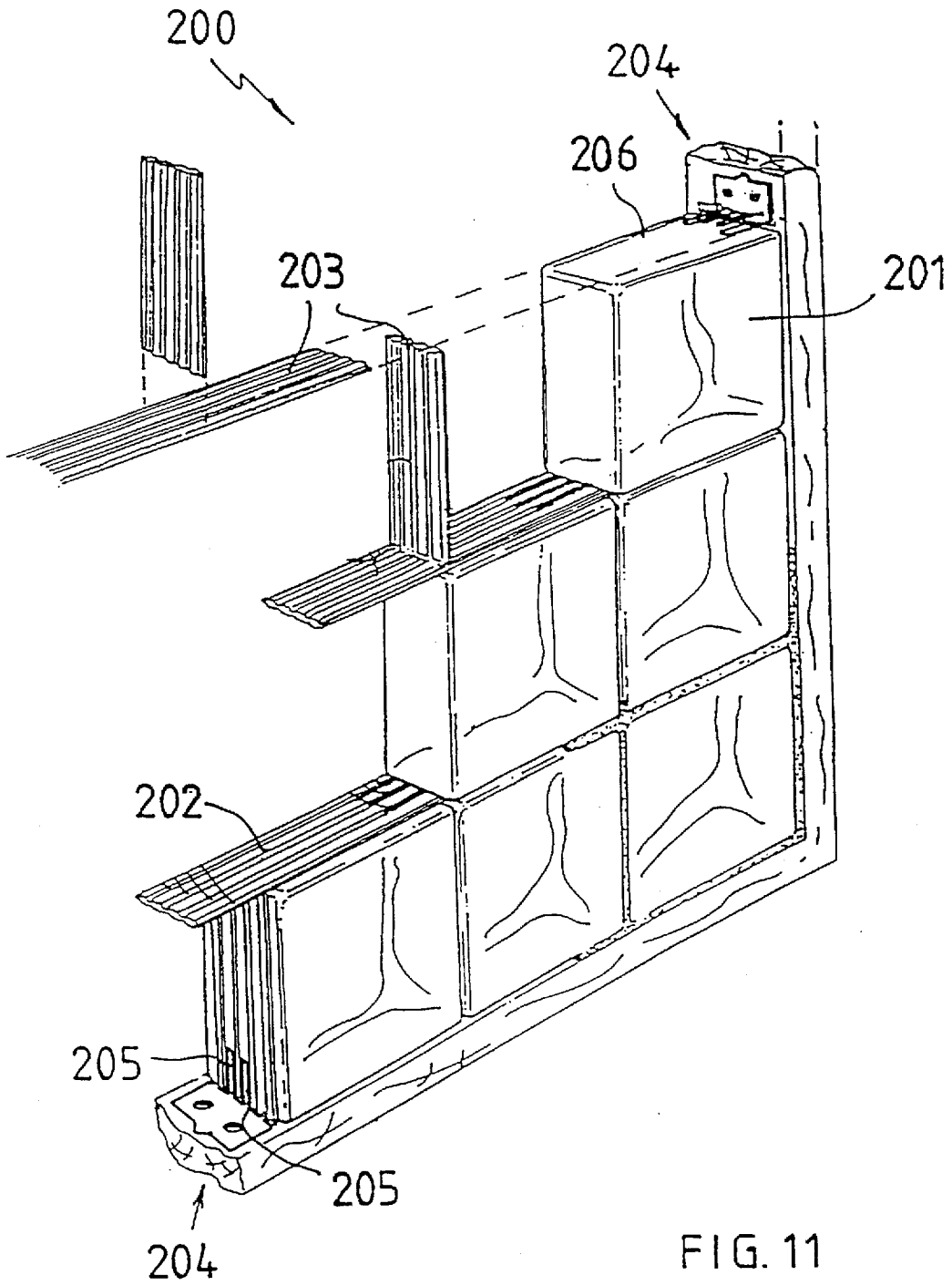
FIG. 11 is a perspective view illustrating a glass brick wall utilising a preferred support assembly according to the present invention.

Referring to FIG. 11, there is illustrated a glass brick wall 200 comprising a plurality of glass bricks 201, the glass bricks 201 being supported by separation strips 202 carrying beading 203 and being held in place by brackets 204, the brackets 204 having projecting fingers 205 which are adapted to extend into channels 206 of the glass bricks 201 so the fingers 205 are disposed between the separation strips and the glass bricks.

Figure 12:
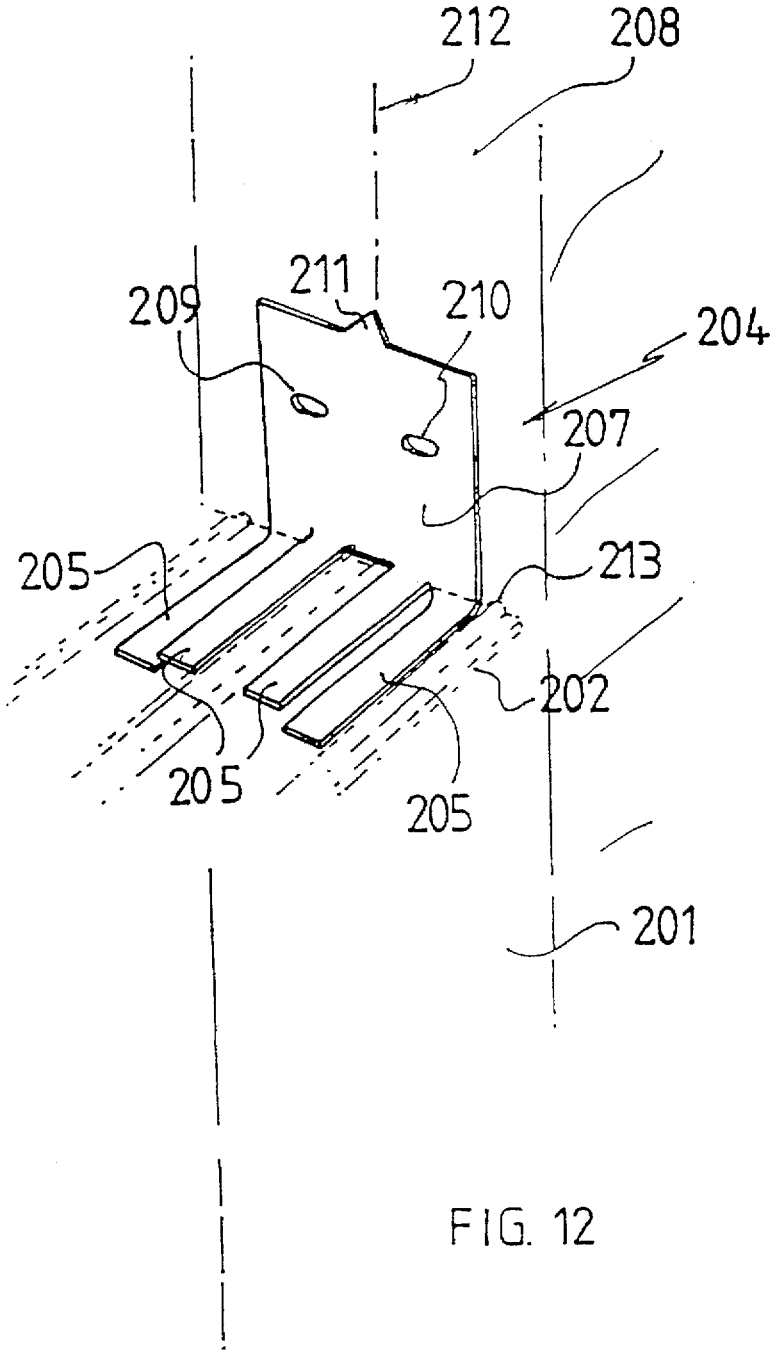
FIG. 12 is a detailed view of a typical support assembly.

This can be see in more detail in FIG. 12 where like numerals have been used to illustrate like features.

As can be seen the bracket 204 includes a plate section 207 secured to a timber frame 208 by a pair of screws 209 and 210, the bracket 204 being located in place by aligning the pointer portion 211 with a locating line 212 drawn on the timber frame 208. This enables the bracket 204 to be located in the proper position so that the separation strip 202 (shown in phantom) is automatically positioned correctly due to the position of the projecting fingers 205. As can be seen, the fingers 205 have been positioned to straddle the end 213 on the separation strip 202.

In the case illustrated the fingers 205 are just thick enough so that they do not extend above the beading on the separation strip 202 so that they fit flush and are positioned between the separation strip and the adjacent glass bricks without interfering with the positioning of the glass bricks in the glass brick wall.

The brackets 204 are typically made from sheet metal stamped into the general shape illustrated in FIG. 12.

Whilst the above has been given by way of illustrative example of the present invention, many variations and modifications thereto will be apparent to those skilled in the art without departing from the broad ambit and scope of the invention as set forth in the appended claims.

We claim:

1. A glass brick wall comprising a plurality of generally rectangular glass bricks layed in horizontal runs between spaced elongated vertically extending support frame members, the wall having horizontally extending elongated separation strips between adjacent horizontal runs, characterized in that, the vertical support frame members present a face incorporating vertically spaced horizontal apertures receiving said separation strips.

2. A glass brick wall according to claim 1 wherein the apertures are spaced horizontal slots.

3. A glass brick wall according to claim 1 or claim 2 wherein each of said vertical support frame members has a channel-like cross-section.

4. A glass brick wall according to claim 1 or claim 2 wherein each glass brick is made from edge welded together dish-like sections having a weld bead extending around the brick in a shallow recessed side wall thereof, each separation strip being self locating in adjacent recesses of adjacent horizontal runs of bricks.

5. A glass brick wall according to claim 1 or claim 2 wherein each glass brick is made from edge welded together dish-like sections having a weld bead extending around the brick in a shallow recessed side wall thereof, each separation strip being self locating in adjacent recesses of adjacent horizontal runs of bricks, each separation strip having transversely spaced pairs of back-to-back channels for holding jointing paste and opposed relatively thick longitudinally extending marginal edge portions adjacent the channels and there being provided at the juncture between the channels and the marginal edge portions, recess register means adapted to project into the glass brick recess to automatically locate the separation strip, each pair of back-to-back channels sharing a relatively thin wall and the separation strip having a relatively thick central medial portion located over the weld bead.

6. A glass brick wall according to claim 1 or claim 2 wherein the wall has a curved shape in plan, the separation strips having wedge shaped cut-out sections and the strips having been manually manipulated to provide generally curved separation strips between the horizontal runs of glass bricks of the curved glass brick wall.

7. A glass brick wall according to claim 1 or claim 2 wherein the separation strip has tapered register means adapted to automatically centrally locate the separation strip in a recess in a side wall of a glass brick, where the recess of the glass brick includes substantially upright inner walls or tapered inner walls.

8. A glass brick wall according to claim 1 or claim 2 wherein the separation strips are received in said apertures as a tight fit.

9. A glass brick wall according to claim 1 wherein each separation strip involves an elongated strip of thin sheet material marginally narrower than the width of a side wall of a glass brick, the glass brick being of the type made from welded together halves where the side wall has a relatively wide and shallow recess extending around the glass brick and a weld bead generally centrally disposed in the recess, the strip having opposed marginal edge portions adapted to fit between adjacent glass bricks just beyond the shallow recess and having tapered recess register means merging from the marginal edge portions and extending into the shallow recesses of adjacent glass bricks, so that the separation strip is automatically centred in the recesses of adjacent glass bricks.

10. A glass brick wall according to claim 1 wherein each separation strip employs spaced pairs of back-to-back channels for holding jointing paste, the channels being inboard of a recess register means and being bounded by the recess register means and inner elongate beading members, the separation strips having relatively thick marginal edge portions and the back-to-back channels being separated by a relatively thin shared wall so as to minimise the amount of material used in the separation strip without compromising strength.

11. A glass brick wall according to claim 9 or claim 1 wherein in order to maintain the strength of the strip, the strip includes a medially bulged portion having back-to-back relatively narrow channels positioned and adapted to accommodate the respective weld beads of adjacent glass bricks.

12. A glass brick wall according to claim 1 or claim 2 wherein the vertical support frame members include a marginal portion having a frangible join so the marginal portion can be removed by separation at the frangible join.

13. A glass brick wall having at least one separation strip and a vertical frame member with a plurality of vertically spaced horizontal slots, wherein each glass brick is made from edge welded together dish-like sections having a weld bead extending around the brick in a shallow recessed side wall thereof, each separation strip being self locating in adjacent recesses of adjacent horizontal runs of bricks, each separation strip having transversely spaced pairs of back-to-back channels for holding jointing paste and opposed relatively thick longitudinally extending marginal edge portions adjacent the channels and there being provided at the juncture between the channels and the marginal edge portions, recess register means adapted to project into the glass brick recess to automatically locate the separation strip, each pair of back-to-back channels sharing a relatively thin wall and the separation strip having a relatively thick central medial portion located over the weld bead, and at least one end of a separation strip projecting into a respective horizontal slot in said frame member.

14. A glass brick wall according to claim 13 wherein the channels are inboard of a recess register means and being bounded by the back-to-back recess register means and inner elongate beading members, the separation strips having relatively thick marginal edge portions and the back-to-back channels being separated by said relatively thin shared wall so as to minimise the amount of material used in the separation strip without compromising strength.

15. A curved glass brick wall including a vertical frame member having a plurality of vertically spaced horizontal slots, and a separation strip between adjacent horizontal runs of glass bricks, the separation strip having cut-out portions at spaced intervals between straight separation strip sections so that the cut-out portions provide a bending site so adjacent straight separation strip sections in the wall are angled relative to one another to provide an overall curve, at least one end of said separation strip coupling with a corresponding horizontal slot of said vertical frame member.

16. A curved glass brick wall according to claim 15 wherein the separation strip has a continuous central, longitudinally extending thickened portion and opposed cutout portions on opposite sides of the thickened portion at intervals corresponding to a width of a glass brick.

17. A glass brick wall comprising a plurality of generally rectangular glass bricks layed in horizontal runs between spaced elongated vertically extending support frame members, the wall having horizontally extending elongated separation strips between adjacent horizontal runs, characterized in that, the separation strips have opposed longitudinally extending beading locating the separation strips between the runs of bricks and each separation strip being supported on at least one end by a bracket having a support member projecting into a space between a channel of an adjacent glass brick and the separation strip.

18. A glass brick wall having a support assembly utilizing channels so formed in the glass bricks to support a separation strip between adjacent glass bricks, the separation strip having opposed longitudinally extending beading locating the separation strip in said channels of said adjacent glass bricks and the separation strip being supported on at least one end by a bracket having a support member projecting into a space between a channel of an adjacent glass brick and the separation strip.

19. A glass brick wall according to claim 6 wherein one of said cut-out sections is located adjacent a vertical support and a removable clip engaging said cut-out section retains said separation strip in said aperture.

20. A glass brick wall according to claim 17 or claim 18 wherein the support member is a plurality of fingers adapted to straddle the separation strip thereby projecting into the channels above and below the separation strip.

21. A glass brick wall according to claim 17 or 18 wherein the support member is a plurality of fingers adapted to straddle the separation strip thereby projecting into the channels above and below the separation strip, the fingers being about the same thickness as the beading so that the fingers locate flush or below the beading in the separation strips.

22. A glass brick wall according to claim 17 or 18 wherein the support member is a plurality of fingers adapted to straddle the separation strip thereby projecting into the channels above and below the separation strip, two fingers being positioned on either side of the separation strip, the fingers protruding generally at 90° to a bracket body, the bracket body being generally planar and being adapted to be fastened to a wall, frame or the like.

23. A glass brick wall according to claim 17 or 18 wherein the bracket includes a marker or position indicating means so the bracket can be located at a predetermined position so that the separation strip supported by the bracket is positioned generally at 90° to the bracket.

24. A curved glass brick wall according to claim 15 or claim 16 wherein one of said cut-out portions is located adjacent a vertical support and a removable clip engaging said cut-out portion retains said separation strip in said aperture.

25. A glass brick wall comprising:

a plurality of generally rectangular glass bricks layed in horizontal runs between spaced elongated vertically extending support frame members, the wall having horizontally extending elongated separation strips between adjacent horizontal runs, characterized in that, the vertical support frame members present a face incorporating vertically spaced apertures receiving said separation strips, wherein each of said vertical support frame members has a channel-like cross-section including a bridging web section extending between opposed flanges, said face comprising an outer face of said web section and a vertical run of said bricks abuts against said outer face of said web section.

26. A glass brick wall comprising:

a plurality of generally rectangular glass bricks layed in horizontal runs between spaced elongated vertically extending support frame members, the wall having horizontally extending elongated separation strips between adjacent horizontal runs, characterized in that, the vertical support frame members present a face incorporating vertically spaced apertures receiving said separation strips, wherein each of said vertical frame members has a channel-like cross-section including a bridging web section extending between opposed flanges, at least one of said flanges having at least one return flange, the return flange incorporating vertically spaced apertures aligned with said apertures in said face to provide pairs of apertures and the respective separation strips are received in each pair of apertures.

27. A glass brick wall comprising:

a plurality of generally rectangular glass bricks layed in horizontal runs between spaced elongated vertically extending support frame members, the wall having horizontally extending elongated separation strips between adjacent horizontal runs, characterized in that, the vertical support frame members present a face incorporating vertically spaced apertures receiving said separation strips, wherein each of said vertical frame members has a channel-like cross-section including a bridging web section extending between opposed flanges, at least one of said flanges having at least one return flange, the return flange incorporating vertically spaced apertures aligned with said apertures in said face to provide pairs of apertures and the respective separation strips are received in each pair of apertures, and wherein the separation strips are received in the apertures as a tight fit.

28. A glass brick wall comprising:

a plurality of generally rectangular glass bricks layed in horizontal runs between spaced elongated vertically extending support frame members, the wall having horizontally extending elongated separation strips between adjacent horizontal runs, characterized in that, the vertical support frame members present a face incorporating vertically spaced apertures receiving said separation strips, wherein the support frame member has a channel-like cross-section including a bridging web section extending between opposed flanges and at least one return flange having a portion abutting against edges of the separation strips to align the separation strips within the support frame.

* * * * *